US008813289B1

(12) United States Patent
Clark et al.

(10) Patent No.: US 8,813,289 B1
(45) Date of Patent: Aug. 26, 2014

(54) MODULAR WHEELCHAIR RAMP INCLUDING DOUBLE-CHANNELED STRINGER

(71) Applicants: David Clark, Jackson, TN (US); Brian Clark, Cordova, TN (US); Paul Clark, Bartlett, TN (US)

(72) Inventors: David Clark, Jackson, TN (US); Brian Clark, Cordova, TN (US); Paul Clark, Bartlett, TN (US)

(73) Assignee: American Access, Inc., Bartlett, TN (US)

( * ) Notice: Subject to any disclaimer, the term of this patent is extended or adjusted under 35 U.S.C. 154(b) by 0 days.

(21) Appl. No.: 14/049,132

(22) Filed: Oct. 8, 2013

(51) Int. Cl.
*E01D 19/00* (2006.01)
*E04F 11/00* (2006.01)

(52) U.S. Cl.
CPC ..... *E04F 11/002* (2013.01)
USPC ..... 14/69.5

(58) Field of Classification Search
USPC ..... 52/716.8, 800.1; 14/69.5, 71.1; 414/921; 119/847
See application file for complete search history.

(56) References Cited

U.S. PATENT DOCUMENTS

| | | | | | |
|---|---|---|---|---|---|
| 3,052,008 | A * | 9/1962 | Bowden et al. | ..... | 249/192 |
| 3,312,032 | A * | 4/1967 | Ames | ..... | 52/580 |
| 3,332,197 | A * | 7/1967 | Hinkle | ..... | 52/844 |
| 3,423,780 | A * | 1/1969 | Alten | ..... | 14/69.5 |
| 3,517,791 | A * | 6/1970 | Miles | ..... | 193/41 |
| 4,201,026 | A * | 5/1980 | Murphy | ..... | 52/844 |
| 4,896,851 | A * | 1/1990 | Shaull | ..... | 248/72 |
| 6,634,848 | B2 * | 10/2003 | Henderson | ..... | 414/537 |
| 6,652,313 | B2 * | 11/2003 | Lambiaso | ..... | 439/521 |
| 7,735,780 | B2 * | 6/2010 | Coles | ..... | 244/132 |
| 7,827,641 | B2 * | 11/2010 | Hoffman et al. | ..... | 14/69.5 |
| 7,861,986 | B2 * | 1/2011 | Cline | ..... | 248/201 |

* cited by examiner

*Primary Examiner* — Gary Hartmann
(74) *Attorney, Agent, or Firm* — Wyatt, Tarrant & Combs, LLP; William S. Parks

(57) ABSTRACT

An easy-to-construct modular wheelchair ramp with reliable dimensional stability in excess of all current regulatory requirements is provided. Such a modular device allows for a variety of ramp materials to be incorporated therein on demand as well as the utilization of any desired ramp pitch without any need to adjust (let alone actually use) connecting brackets and/or under-section supports. The double-channel stringer configuration thus allows for support legs to easily connect and move along such a component for facilitated set-up. Additionally, the double-channeled structure allows for any handrail materials to be properly and easily secured thereto. The stringer alone, as well as the overall modular ramp structure, are encompassed within this invention. The method of constructing such a wheelchair ramp is also envisioned within the invention.

18 Claims, 7 Drawing Sheets

MODULAR WHEELCHAIR RAMP INCLUDING DOUBLE-CHANNELED STRINGER

FIELD OF THE INVENTION

The present invention relates to an easy-to-construct modular wheelchair ramp with reliable dimensional stability in excess of all current regulatory requirements. Such a modular device allows for a variety of ramp materials to be incorporated therein on demand as well as the utilization of any desired ramp pitch without any need to adjust (let alone actually use) connecting brackets and/or under-section supports. The double-channel stringer configuration thus allows for support legs to easily connect and move along such a component for facilitated set-up. Additionally, the double-channeled structure allows for any handrail materials to be properly and easily secured thereto. The stringer alone, as well as the overall modular ramp structure, are encompassed within this invention. The method of constructing such a wheelchair ramp is also envisioned within the invention.

BACKGROUND OF THE INVENTION

With the advent of the American Disabilities Act, many commercial establishments, governmental buildings, and other public facilities have been required to accommodate individuals that utilize wheelchairs and automated cart devices for access. With an aging population, the numbers of people utilizing such devices has increased significantly in recent years, as well, consequently increasing not only the need for reliable ramp structures for such purposes. Though some facilities have concrete and other like ramp structures constructed for long-term viability in this manner, the vast majority of establishments depend upon separately constructed ramps to allow patrons, etc., desired interior access, particularly if the elevation of such a building is above that of the exterior (even by a few inches).

The costs associated with concrete ramp materials, as well as the potential for erosion over certain time periods, have proven to be difficult for some commercial establishments, etc., to rationalize. Furthermore, the necessity of setting the ramp level (pitch angle) at a required measurement over time, and the potential for erosion through environmental exposure over time, let alone the potential need to replace the surface tread (if present) on such concrete structures to ensure proper operation within regulation compliance standards, at least, has also militated against widespread application thereof. Completely wooden ramp structures have been provided in different locations (such as, for example, outside modular buildings at schools, and the like) to reduce initial costs. However, sun, rain, and other continuous exposure to the elements cause noticeable damage over even short periods of time for such structures. Wooden components may be easily replaced, if needed, but the susceptibility of such ramps to damage has rendered complete reliance on these types of structures undesirable. Additionally, the desired aesthetic quality of these completely wooden structures, particularly after even a few months, if not weeks, of environmental exposure and use requires significant upkeep. Base structures that are less expensive than concrete and more reliable than completely wooden types are thus not only acceptable within the wheelchair ramp industry, but far more desirable.

Many different metal-based structures have thus been provided as alternatives. With such ramps, a metal-based tread component is typically placed upon cross-ties that are connected to perpendicular angled straight boards. Typically, supports are connected to underlying structures to provide stability to the pitched ramp in this configuration. Such a pitch support arrangement is rather difficult to erect, unfortunately, and, furthermore, places a large amount of stress on the under-section portions. Additionally, initial construction of such a ramp is generally complex, requiring extended time and resources for such a purpose. As well, any change in ramp pitch subsequent to initial ramp construction requires complete realignment of the supports themselves to allow for even slight angular modifications. Setting the same height for both sides of a ramp with such a configuration is also potentially difficult, particularly if the ground surface is not uniform; even a slight difference in terrain height from one side to another requires significant operation to manipulate the under-section support component or, potentially, leveling of the ground itself. Furthermore, the incorporation of handrails (another ADA required component of such ramp structures) requires extra connection capability; providing such rails at the same angle as the ramp itself can prove rather taxing to the manufacturer, if not the construction crew, unless specific connection means are provided with angle modifications in place. Perhaps more troubling, though, is the lack of appreciable connection locations for such handrails to side boards. Such rails may easily disassociate from such boards over time if the connection components are limited in number and strength. Overcoming this further potential deficiency would be of great importance, as well.

Of further limit to such past and current metal-based ramp structures is the lack of full reliability that the ramp portions, which are typically of significant weight and density, to remain in place during long-term use. Since these portions are aligned at certain angles, generally, they rely heavily upon the resiliency of the ground on which the lower end is placed. If such ground exhibits any give, again particularly with such a heavy base structure constantly applying pressure thereto, there is potential for the entirety of the ramp to slide a certain distance from its set position, causing a noticeable and potentially dangerous defect. Increasing the reliability of such ramps in this context would be of enormous benefit, certainly.

Additionally, the potential to actually utilize different materials within a metal base would be rather unique, particularly with an overall reliable structure. As alluded to above, wooden components would be desirable from a cost perspective, whether as the ramp itself or the handrail components. Typical metal-based ramp structures are not properly configured to permit such interchangeability without compromising on safety and/or suitable dimensional strength and stability.

All in all, then, there exists the need for an alternative to the present-day concrete, all-wooden, and all metal-based under-section supported (at least) wheelchair ramp structures and devices. In particular, a structure that improves on the ability of the user to not only construct the initial ramp, but also to adjust the same on demand to modify the pitch, at least, with the added capability of easily connecting to any type of handrail in reliable fashion, not to mention the ability to securely hold any type of ramp component in place during long-term use, would be highly prized in the industry. Unfortunately, to date, such improvements have heretofore been unavailable to manufacturers and users alike.

ADVANTAGES AND SUMMARY OF THE INVENTION

It is an advantage of the present invention to provide a reliable modular wheelchair ramp that is not only easy to construct, but also easy to adjust if a different pitch is desired or needed. Another advantage is the ability to provide such a modular ramp structure without any need for connecting brackets, under-section supports, and complex and numerous types of hardware during construction. It is an additional advantage that the inventive ramp structure provides for reliable connection to either wooden or metal materials for the handrail and ramp portions thereof. Yet another advantage of this invention is the ability to reliably connect such ramp and handrail components to parallel stringer portions through two separate and parallel channels exterior to the ramp location. Additionally, this invention provides the advantage that such a channeled stringer component allows for increased weight bearing through the placement of suitable metal or like material strands therein between adjacent stringers.

Accordingly, the present invention encompasses a stringer structure having two opposing ends and a lengthwise portion having a first side and a second side and a top edge and a bottom edge, wherein said first side includes two parallel extended channels separated by a rounded region, wherein said channels are C-shaped, including rounded top and bottom edges leading to openings that are disposed at a location substantially opposite said second side, wherein said extended channels run the full length of said first side of said lengthwise portion, and wherein at least one of said channels includes a rounded edge at the bottom side of said lengthwise portion; wherein said second side includes first and second panels perpendicular to said second side of said lengthwise portion, wherein said first panel is substantially within the same plane as said bottom side of said lengthwise portion, wherein said second panel is at a level even with a portion of said rounded region of said first side of said lengthwise portion. Additionally, the invention may include the configuration of said stringer wherein said second panel is of a length extending from said second side of said lengthwise portion less than the extended length of said first panel.

Furthermore, the invention may also include a modular wheelchair ramp structure including at least two stringer components disposed in parallel relation to one another and as described above, wherein said at least two stringer components include a plurality of leg components having foot portions for placement directly to a ground surface and securely attached (in detachable fashion) to both of said exterior parallel channels thereof simultaneously, wherein a ramp component is inserted between said stringer components within the confines of said first and second panels, wherein said ramp component is disposed at a suitable angle from a highest level to the level of said ground surface such that said at least two stringer components are disposed at substantially the same angle as said ramp component, wherein said leg components are substantially perpendicular to said ground surface, and wherein said structure remains dimensionally stable without any need for any other support than said leg components attached directly and securely to said stringer components. The invention may further encompass the same structure as described above and further including a plurality of such stringer components contacted and attached in linear fashion on either side of said ramp component, and further alternatively including weight-bearing metal strand structures inserted within at least one exterior channels of adjacent linearly aligned stringer components and secured in position such that said strand withstands weight pressures of both adjacent stringer components simultaneously (and wherein two parallel aligned strands of such a type are preferably utilized in such a fashion). Additionally, the invention includes the utilization of "U" shaped leg components that allow for bolts to be attached through openings within the middle portion thereof and into said exterior channels of said stringer components. The invention further permits attachment of handrail components to said stringer external channels through separate, stacked connection means (i.e., each connection mean attaches in reliable fashion to the channels of the stringer, one above the other), allowing for resilient placement during utilization with said ramp structure. As well, the invention also permits the inclusion of any type of suitable ramp structure between said stringer components and inserted between said first and second panels thereof.

Such an inventive device relies, at least, upon the novel stringer configuration described herein. Such a component is all-metal in construction and is preferably, though not necessarily, provided with two parallel panel portions (certainly at least one, but two is preferable) with a bottom panel configured to bear the weight of one side of a ramp component. When in parallel alignment with one another, two such inventive stringer components provide the resilient strength on which the ramp component rests when constructed, basically. The upper panel portion is included, again preferably, to provide an insertion region for the ramp component such that the top and bottom panels retain the ramp in desired inclined position without buckling or other deleterious results. This base top and bottom panel arrangement thus allows for any type of ramp material that may be incorporated in such a fashion (such as wooden, metal, or other like surfaces, including, for example, resilient plastic types, with each either including or not including standard tread portions applied thereto or integrated therein) to allow the user versatility for such a purpose. The user and/or manufacturer may also include intermittent ramp components as reliable and resilient spacers between base ramp portions, if desired. Such a configuration further allows for easier replacement of worn ramp surfaces, as well. Such panel components are preferably made from steel, aluminum, or other like resilient metal material. The bottom panel preferably extends from the stringer base a distance of from 3 to 6 inches, while the top panel preferably extends at its height level from 2 to 4 inches. The top and bottom panels are preferably separated in parallel relation to one another by about 1½ to 3 inches, preferably about 2 inches. Furthermore, the bottom panel is preferably at least 0.2 inch in thickness (up to 0.4 inch), while the top panel is preferably from 0.1 to about 0.25 inch in thickness. The slotted configuration is further enhanced with the ends of each extended panel provided with curved edges to reduce any damage or injury during construction and/or use. These panel components are also to run the full length of each integrated stringer component, thereby providing, in preferred form, an "F" shaped arrangement when viewed from one end or the other of such a stringer component.

The stringer includes, as well, the above-noted double-channel configuration on the side opposite the extended panel (the "slotted" side, as it were). The two channels, as noted previously, are arranged one above the other in a type of parallel disposition. The channels actually extend from the base stringer component (similar to the top and bottom panels of the "slotted" side), exhibiting "C" shaped appearances (when viewed from either end of the stringer). Thus, both channels extend with curved lower edges that lead to openings (the channels) that in turn lead to opposing curved upper edges. Between the two channels is a rounded area, as well, thereby, in relation to the rounded edges of the top and bottom opposing extended panels, providing a substantially rounded edge configuration in total for protective benefits and overall increased strength profiles for the channel portions themselves. These channels thus also run the entire length of the subject stringer component to provide such extended channel portions for reliable connection purposes. With the overall "flat" disposition of a ramp component introduced within the slotted panels of the stringer component, then, the presence of such external parallel channels within the stringer component allows for the further attachment of leg components to provide not only the ability to bear weight atop a ground surface (which may be considered earth, grass, concrete, flooring, carpet, stone, asphalt, basically any such surface on which such a ramp is typically placed inside or outside an edifice), but also the ability to allow for pitch adjustment through contact and connection to said double channels. In this manner, the parallel upper and lower channels permit separate connection points at uniform distances from one another such that the leg components will always remain substantially perpendicular to a subject ground surface without requiring a specific pitch level to be in place for the ramp structure itself. This is accomplished, ostensibly through the inclusion of a suitable opening (or multiple openings) within the middle leg wall (as noted above, such a leg is preferably in a "U" shaped configuration with opposing walls provided in perpendicular relation to the subject stringer channels and the middle wall, the bottom of the "U", in other words, in contact with the stringer channels). Such an opening (or openings) allows for bolts or other like reliable connection means to be introduced through the leg wall opening and into the stringer channels at appropriate, complementary heights. With this opening arrangement, then, the bolts or other connection means may be adjusted suitably to permit different height positions of the two connectors along the vertical leg wall opening while remaining disposed directly in line with one another. Thus, the leg remains perpendicular to the ground surface at all times and the pitch of the ramp is properly accommodated through the leg wall opening at any desired angle. If such a pitch level needs adjustment, the user can thus simply loosen the connectors (bolts, with washers and channel-inserted nut components for the necessary resilient, stable connections to occur) and maneuver the leg in either direction to raise or lower the ramp itself. Thus, with the connection capability of such a double-channel configuration allowing for any suitable ramp pitch (within, for instance, ADA or other local code requirements), the user may adjust such ramp particulars as needed without having to take apart even a portion of the constructed ramp structure for such a purpose. Thus, contrary to typical metal-based structures including under-supports and connection brackets, and the like, the realignment of the inventive structure leg components to raise or lower such a pitch characteristic is sufficient to attain the desired pitch level alone.

The double channel components are thus of sufficiently strong metal constitution to withstand the rigors and tensile strength actions of the connected leg components during use. Steel, aluminum, and the like, are thus preferred for such a purpose.

The leg components themselves are, as noted above, preferably constructed in a "U" shaped configuration with the open-end thereof disposed outwardly from the double channels of the stringer component when in use (and thus the "U" appearance noted when the leg components are in use and one looks straight down on the top of all such legs). In this manner, the middle solid portion of the leg component may include a suitable opening (or, again, openings) thereof (die-punched, for example) to allow for secure bolts (or other like connectors) to pass therethrough into the two parallel channels. A nut (or other like device) may then be attached after being inserted within a channel and the bolt (or other like connector) may then be tightened to the necessary degree for reliable, but detachable (is desired and/or needed), connection between the leg and the stringer. Again, due to the double channel configuration, this connection capability allows for realignment of the leg components to adjust the pitch of the stringer components (and the overall ramp structure) without the need to undo or detach any of the other components. The "U" shaped legs also preferably exhibit curved edges (although with the walls situated at substantially 90° from one another) and specific wall thicknesses for safety purposes as well as for overall strength to better bear weight and strains during utilization thereof. The bolts employed herein (if so desired) are preferably, though not necessarily, of grade 5 hardware; such connection means may be of any type that imparts the needed levels of strength and resiliency described herein, or, alternatively, may be dictated by federal, state, and/or local codes for such a purpose. The ability to utilize specific connector hardware for all such connections eliminates the need for other types of such components, thus further reducing the complexity of manufacture and/or construction. The legs may also have attached to their ground edges feet of any shape and configuration to aid in bearing the ramp weight. Such feet may be attached as temporary extensions, or may be permanently applied (such as through welding, and the like).

The double channel stringer components allow for the further utilization of any type of handrail with the base ramp structure as well. Basically, the reliable stringer connections through the double channels permits a user to undertake handrail connections in a similar manner to the connections for the legs described above. The utilization of suitably reliable, strong, and resilient bolts, nuts, washers, etc., for this purpose thus permits a user to include any type of handrail structure, made from any suitable material, such as metal, wood, plastic, or a combination of all such materials, if desired, as a component within his or her finished ramp structure. The handrails may thus be disposed at the same angle as the ramp (and stringers) in this manner since such handrail base openings for such connections to occur would be at set distances in relation specifically to the distance between the two parallel stringer channels. In any event, this possibility allows, again, for any type of material to be selected and utilized for such a handrail purpose without any appreciable loss of reliability or dimensional stability of the base leg/stringer/ramp composite structure itself.

Thus, with these base components, the overall ramp structure may be easily put together by a professional or by a person in do-it-yourself mode. One possible manner of undertaking such a construction process would be to first align two stringers in parallel with each facing inward with the top and bottom panels in that manner. The user may then insert a desired ramp component between the two sets of top and bottom panels to determine distance between the two stringers. If more than one stringer is utilized, such may be properly configured to allow for, for example, tongue and groove alignment as a means to provide more than one stringer on either side of the subject ramp component. Likewise, if more than one ramp component piece is needed to complete the full length of the desired ramp structure, such may be provided in a tongue and groove or other like fashion to aid in reliable connection thereto. Once the full stringer/ramp component structure is completed, the user may then decide the proper pitch level to be employed (such as through the raising of the initial stringer/ramp component structure at its expected high end at the level of the edifice entrance or other like location, and extending the structure to its intended end point). The "U" shaped legs may then be properly attached to the double channels of the stringer component (external the ramp structure, of course) at the desired pitch level (and thus at a selected point along the length of the stringer in accordance with the height of the connectors available) thereof. Upon connection of legs on either side, and of any number to provide the desired secure connection for ramp level reliability during use, the user may then introduce handrails to the stringer channels and insert connectors (again, preferably, bolts, with washers) through openings provided within the handrail bases to align with nuts (or other like objects) that can be inserted within such stringer channels for attachment with the aforementioned handrail base connectors (e.g., bolts). Upon securing of such rails, the entire wheelchair ramp structure is ready for use.

With this overall structure, the user may select any type of ramp component for utilization therewith without any loss in resiliency or overall reliability. Different treads may be applied to such ramp components, as well, to further improve upon the reliability and capability of the subject wheelchair ramp structure, as well. The same may be said of the handrail components, too, as a user may desire, for aesthetic, safety, etc., purposes, to utilize certain wooden materials for such a purpose, rather than a metal component. Such versatility, particularly coupled with overall resiliency and strength of the base structure itself, and, additionally, the ability to easily construct such a device in a do-it-yourself fashion with the pitch adjustment capability, too, is simply nonexistent within the industry as of today. The removal of any need for utilizing extra connection and/or support brackets to provide weight bearing and other characteristics, permits the highly prized capability noted above of adjustment of pitch on demand without any compromise in ramp stability, nor any need to remove ramp components to achieve such an end. Again, this benefit is currently not available with other ramp devices.

Additionally, the double channel configuration of the stringer component also allows for the introduction of load-bearing metal structures (strands and the like) that may be easily inserted within the channels themselves and placed in overlapping relation between two separate, yet adjacent stringer components. Such load-bearing structures may thus increase the overall resiliency and stability of the ramp structure and aid in reducing any propensity of the ramp to sage or otherwise become disengaged during long-term use. Secure bolts, and the like, may be introduced on both ends (or just the lower end) of such a load-bearing inserted metal structure to retain its position for such a purpose as well. In this manner, the benefits of the double channel configuration are compounded beyond the noticeable improvements provided as described previously.

DETAILED DESCRIPTION OF THE DRAWINGS AND PREFERRED EMBODIMENTS OF THE INVENTION

Hereinafter, preferred embodiments of the present invention will now be described with reference to the accompanying drawing. Such descriptions are not intended to limit the scope of the overall invention but only to provide one potential embodiment thereof.

Figure 2:
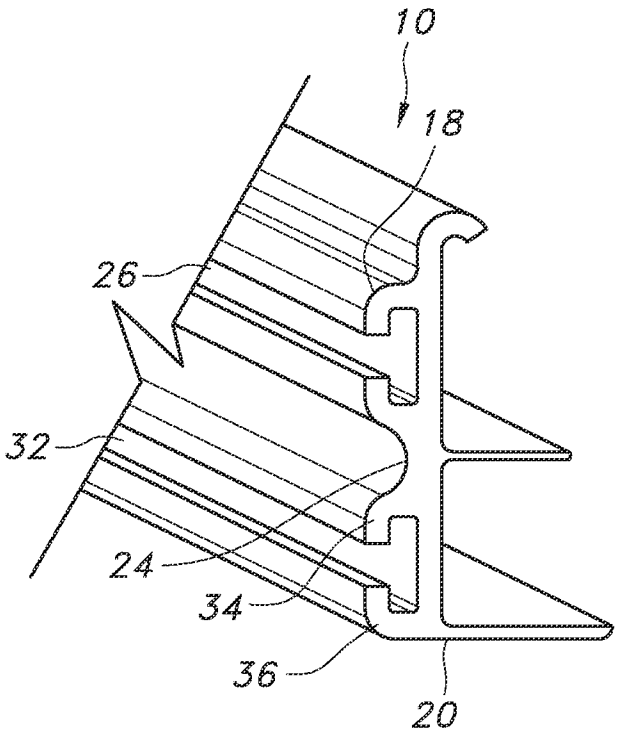
FIG. 2 depicts a side perspective view of the inventive stringer component of FIG. 1.
Figure 1:
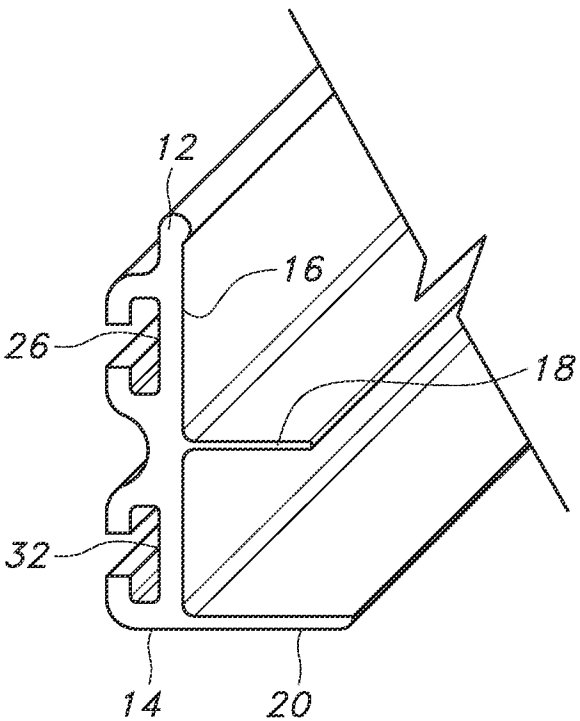
FIG. 1 depicts a cross-sectional side view of the inventive stringer component for utilization within a wheelchair ramp.

As shown in FIGS. 1 and 2, a stringer 10 is provided including a top "middle" edge 12, a bottom edge 14, an internal side 16 including a top extended panel 18 and a bottom extended panel 20. The opposite, external side 22 includes two separate, parallel channels 26, 32 formed by upper curved extensions 28, 34 and lower curved extensions 30, 36 (thus forming two "C" shaped extensions) separated by a rounded middle area 24. The internal side 16 noticeable shows, in this potentially preferred embodiment, the different lengths of the panels 18, 20, thereby creating, if the stringer is rotated 180°, a "F" shape for the stringer itself. In FIG. 2, the lengthwise presence of the channels 26, 32 and other integrated components is better seen. The top and bottom panels 18, 20 likewise run the length of the stringer in similar fashion.

Figure 3:
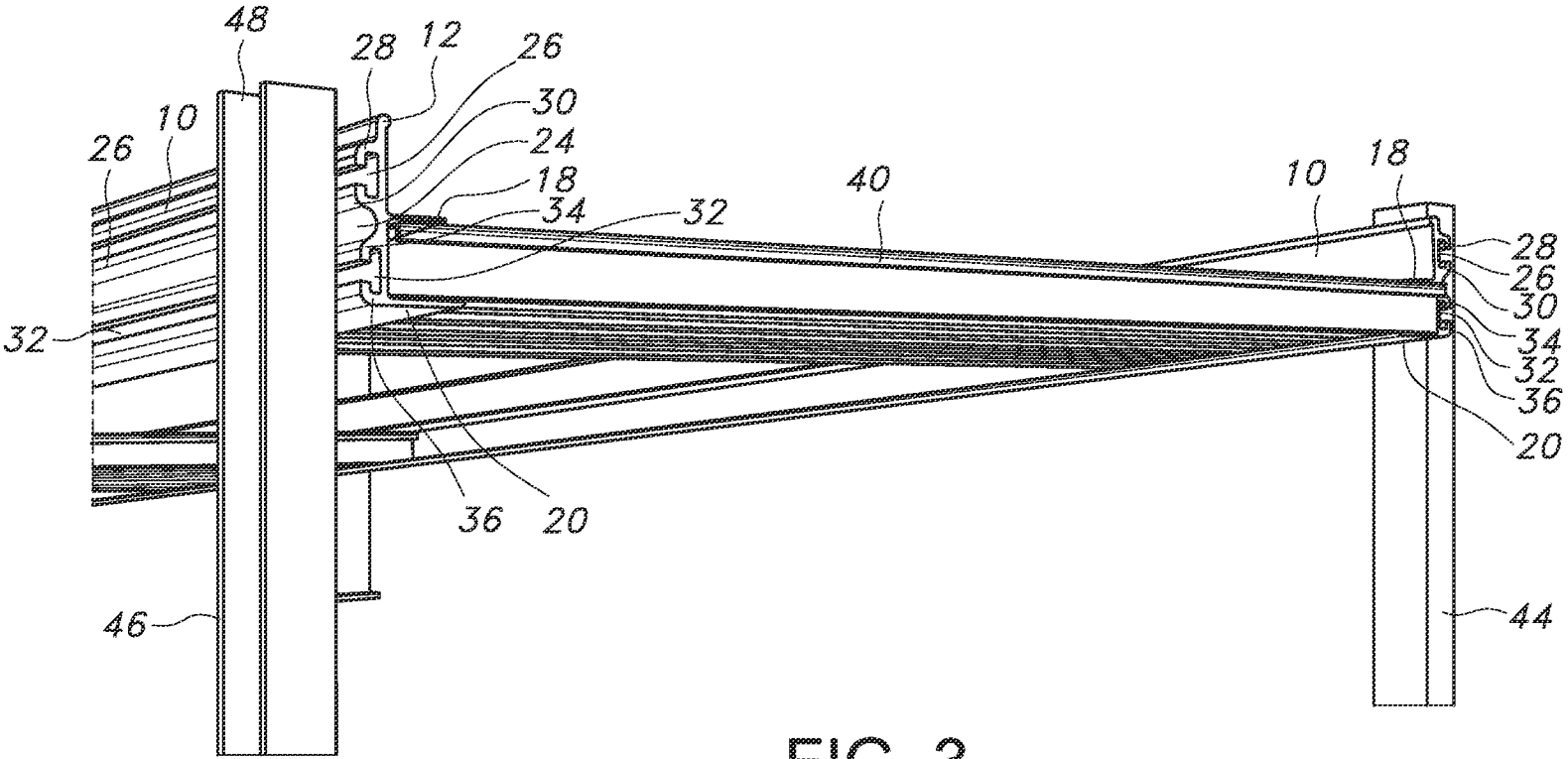
FIG. 3 is an a side perspective view of a portion of a wheelchair ramp constructed with the inventive stringer component of FIGS. 1 and 2.
Figure 4:
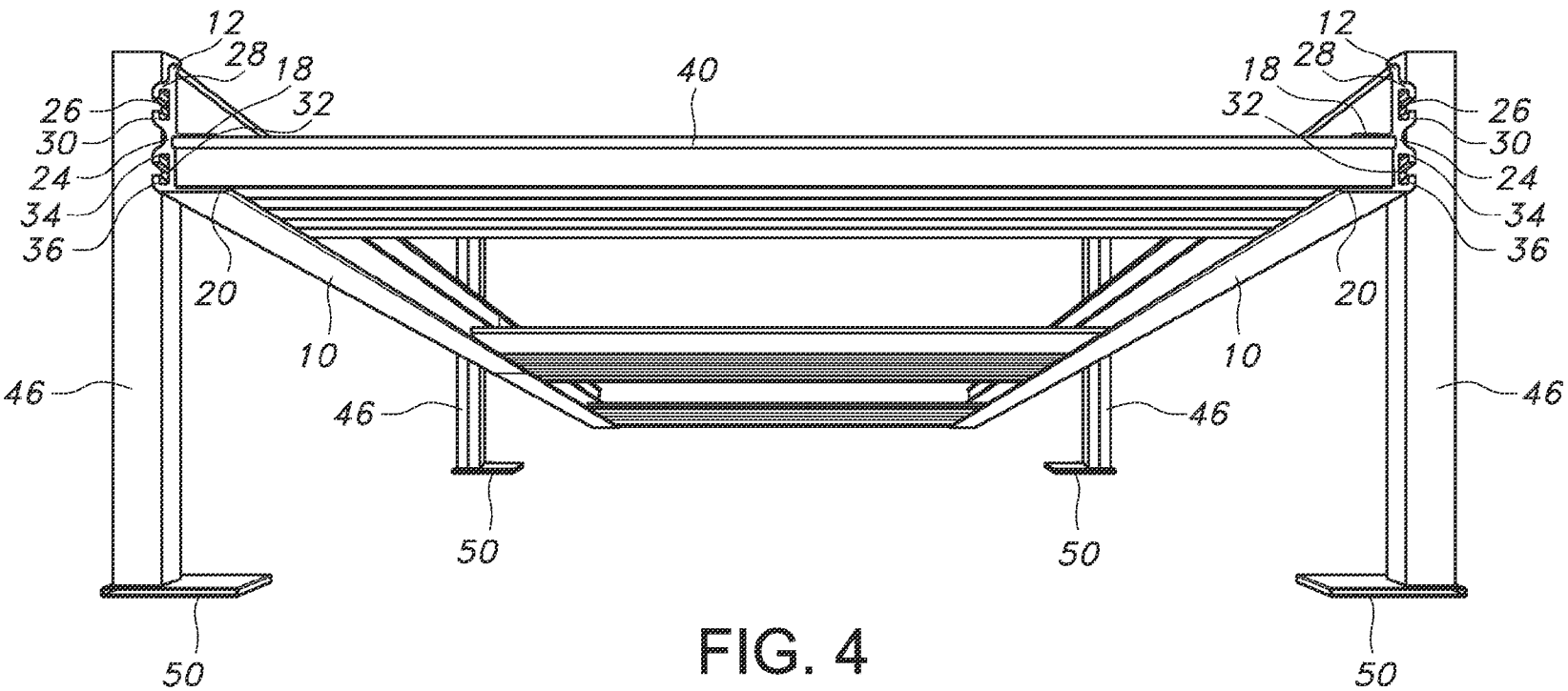
FIG. 4 is an end perspective view of the wheelchair ramp portion of FIG. 3.
Figure 5:
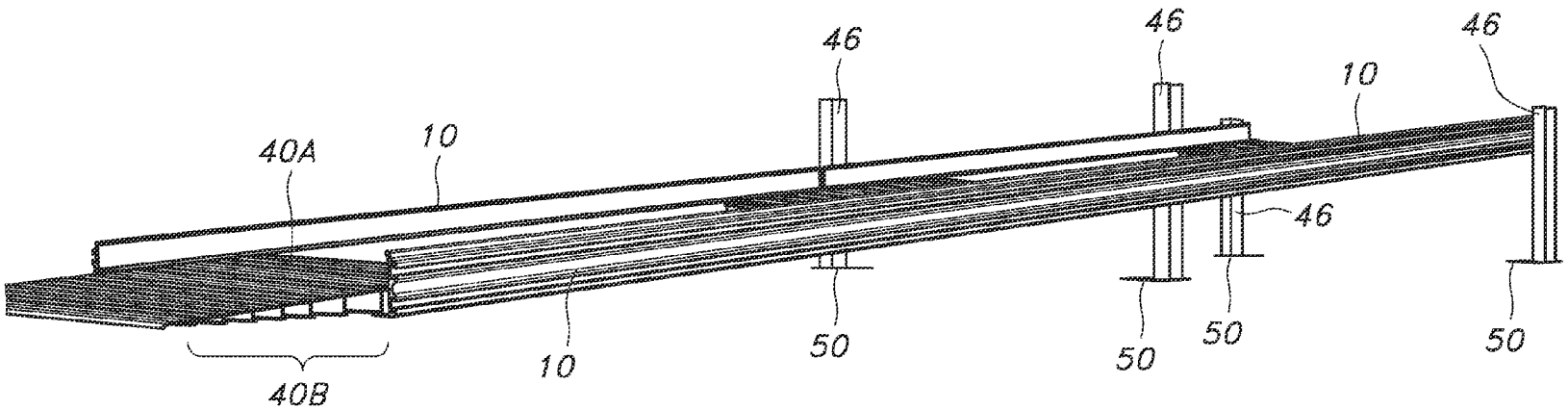
FIG. 5 is a side landscape view of the wheelchair ramp portion of FIG. 4.
Figure 6:
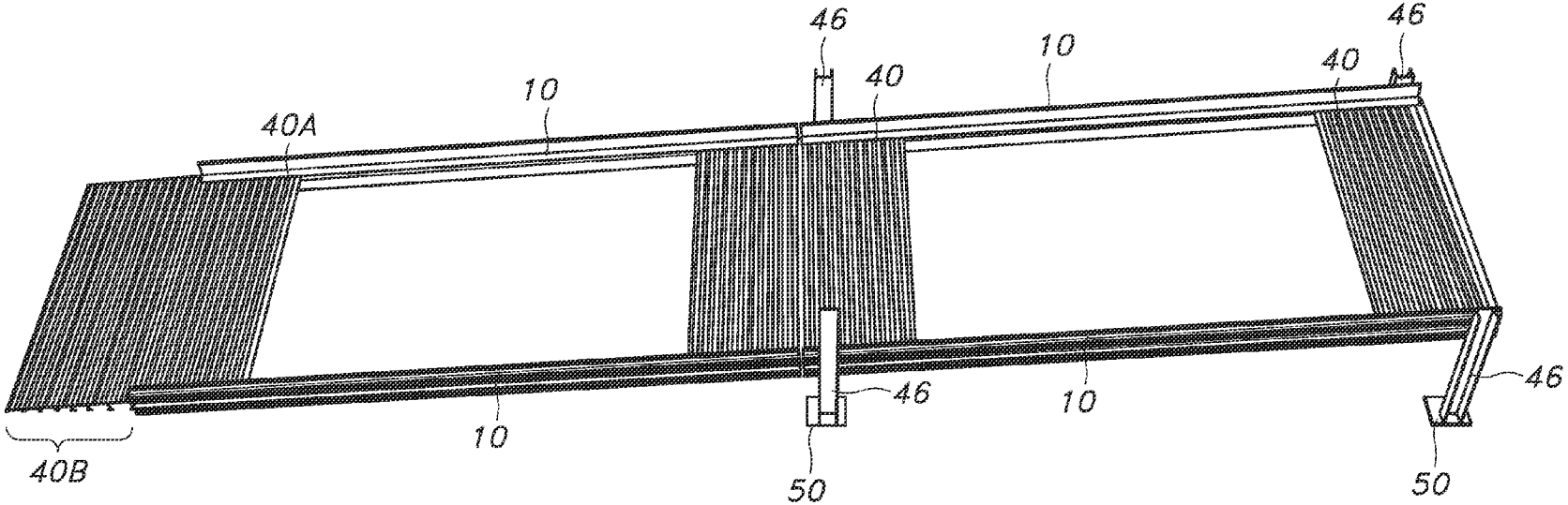
FIG. 6 is a side elevated view of the wheelchair ramp portion of FIG. 5.

FIG. 3 provides a perspective view of the initial insertion of a ramp component 40 between two stringers 10 and between two upper panels 18 and two lower panels 20. Additionally, "U" shaped legs 44, 46 are attached through connections (not illustrated) inserted within the channels 26, 32. As alluded to above, this double channeled configuration allows for such legs 44, 46 to adjust along the length of the stringer 10 to allow for pitch modifications on demand. The "U" shaped legs 44, 46 include top openings 48 and solid side walls to allow for increased strength and resiliency during support use, as well. FIG. 4 provides a similar view as in FIG. 3 with the pitch of the ramp 40 and stringers 10 more evident, and showing the level of connection between stringers 10 and legs 46 differing in relation to the pitch level itself. Additionally, the legs 46 show stabilizing feet 50 included thereon for extra balance, etc., as needed. FIGS. 5 and 6 thus show further differing views of the same ramp structure. Noticeable as well is the ground surface ramp component 40A that exhibits necessary gradations 40B to allow for proper alignment in angled configuration with the ground surface (not illustrated) itself.

Figure 7:
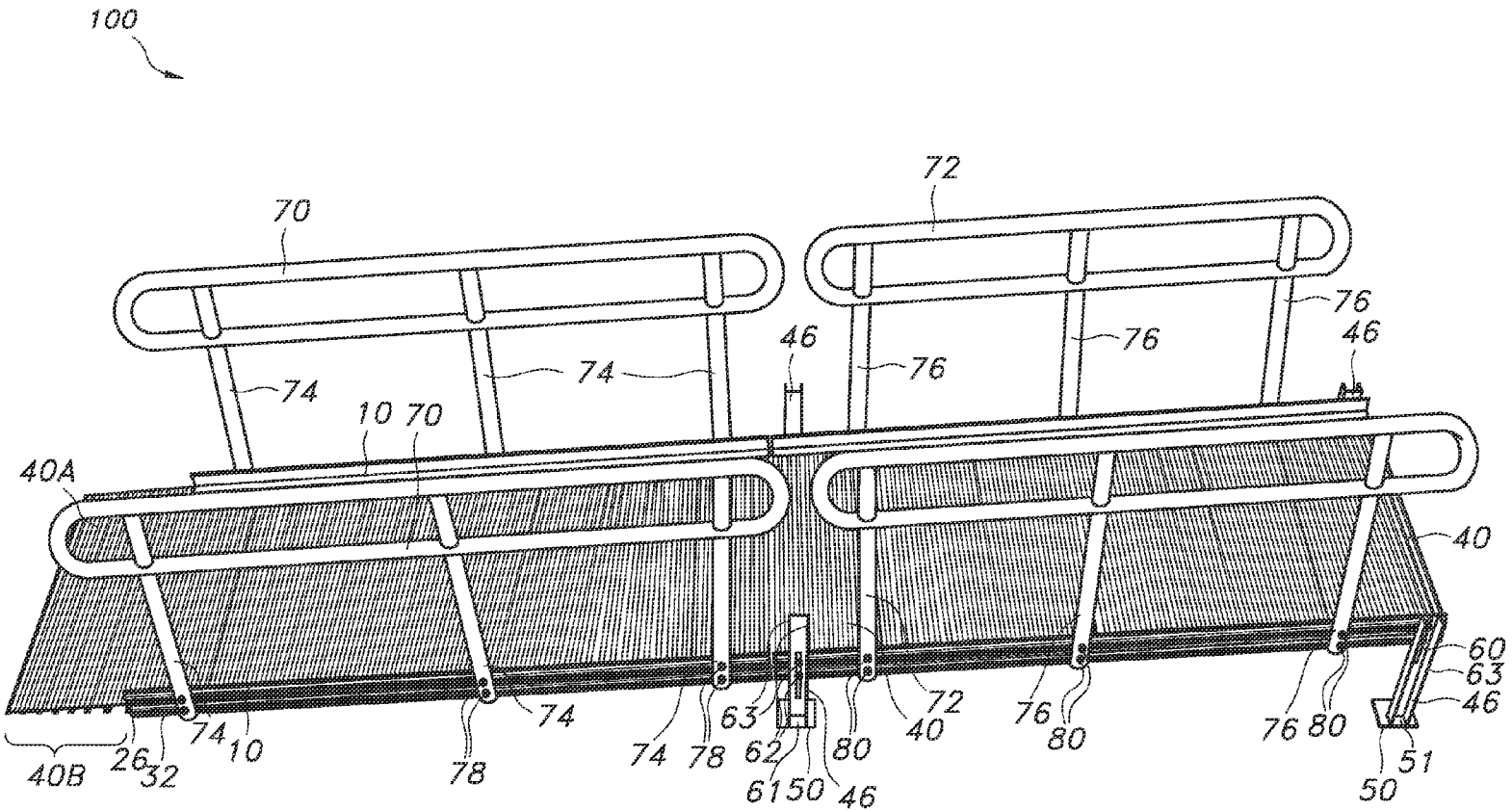
FIG. 7 is a perspective view of an entire inventive wheelchair ramp with handrails present.

FIG. 7 thus provides a view of a ramp 100 constructed in accordance with the invention with ramp components 40 and a ground surface ramp component 40A (with gradated bottom portions 40B), including the stringer structures 10 having two channels 26, 32 running the length thereof. Attached to the stringer structures 10 are, as noted above, U-shaped legs 46 including attached bases 50. The legs 46 include a middle wall 61 and two opposing side walls 63 perpendicular to the middle wall 61. Within the middle wall 61 are openings 60 that permit pass-through of connectors 62 into the stringer channels 26, 32. As noted previously, the openings 60 allow for adjustment of the connectors 62 to remain vertically aligned within the confines of the leg opening 60 with the capability of adjusting the pitch of the stringer structures 10 (and thus the overall ramp components 40). Additionally, handrails 70, 72 have been attached to the stringer structures 10 through the use of like connectors 78, 80 that pass through openings (not illustrated) within bases 74, 76 of such handrails 70, 72. In this manner, the channels 26, 32 are employed to also permit attachment with the handrails connectors 78, 80 (such as, for example, grade 5 bolts, washers, and the like) with suitable nuts or other like devices (not illustrated) inserted within the stringer channels 26, 32 for acceptance, introduction, and resilient tightening. The same type of bolts, etc., may be utilized for the legs 46 to be attached as well.

Figure 8:
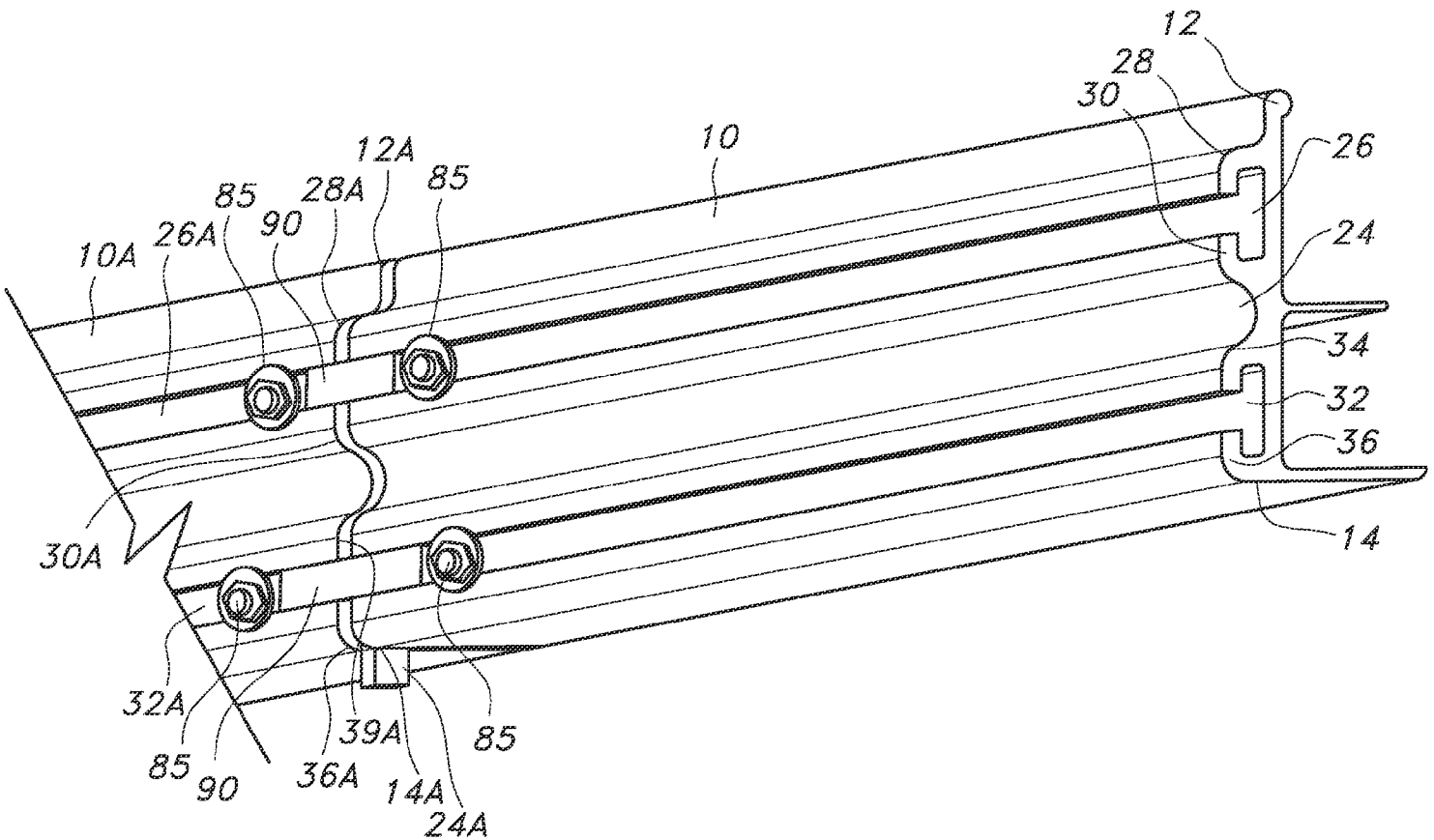
FIG. 8 is a close-up perspective view of an inventive wheelchair ramp (as in FIG. 7) with the inclusion of metal strands for weight bearing purposes within the exterior channels of adjacent stringer components.

FIG. 8 provides an alternative manner of increasing load-bearing utilizing the benefits of the stringer channels 26, 32. In this instance, two separate stringers 10, 10A are placed adjacent to one another with alignment of similarly shaped channels 26, 26A, 32, 32A, at least. Inserted within both adjacent sets of channels 26, 26A, 32, 32A are separate and parallel disposed metal bars 90, with the bars 90 positioned to overlap portions of both stringers 10, 10A. Secure bolts 85 are utilized to keep the bars 90 in such desired positions, as well. In this manner, the metal bars 90 allow for increased load-bearing of the adjacent stringers 10, 10A as well as permitting greater reliability to the user that the overall ramp (100 in FIG. 7) will remain at its disposed pitch level. Thus, the benefits of the stringer channels 26, 26A, 32, 32A are further compounded with this alternative characteristic.

Ultimately, all of these described configurations, etc., allow for greater efficiencies in construction, greater reliability on structural integrity and dimensional stability of the subject ramp structure during long-term use, and the ability to adjust pitch levels on demand, all with an overall device that is relatively easy to construct and install without the need for professional help.

The preceding examples are set forth to illustrate the principles of the invention, and specific embodiments of operation of the invention. The examples are not intended to limit the scope of the method. Additional embodiments and advantages within the scope of the claimed invention will be apparent to one of ordinary skill in the art.

What we claim is:

1. A stringer structure having two opposing ends and a lengthwise portion having a first side and a second side and a top edge and a bottom edge, wherein said first side includes two parallel extended channels separated by a rounded region, wherein said channels are C-shaped, including rounded top and bottom edges leading to openings that are disposed at a location substantially opposite said second side, wherein said extended channels run the full length of said first side of said lengthwise portion, and wherein at least one of said channels includes a rounded edge at the bottom side of said lengthwise portion; wherein said second side includes first and second panels perpendicular to said second side of said lengthwise portion, wherein said first panel is substantially within the same plane as said bottom side of said lengthwise portion, wherein said second panel is at a level even with a portion of said rounded region of said first side of said lengthwise portion.

2. The stringer structure of claim 1 wherein said second panel is of a length extending from said second side of said lengthwise portion less than the extended length of said first panel.

3. A modular wheelchair ramp structure including at least two stringer components disposed in parallel relation to one another and as described in claim 1 above, wherein said at least two stringer components include a plurality of leg components having foot portions for placement directly to a ground surface and securely attached to both of said exterior parallel channels thereof simultaneously, wherein a ramp component is inserted between said stringer components within the confines of said first and second panels, wherein said ramp component is disposed at a suitable angle from a highest level to the level of said ground surface such that said at least two stringer components are disposed at substantially the same angle as said ramp component, wherein said leg components are substantially perpendicular to said ground surface, and wherein said structure remains dimensionally stable without any need for any other support than said leg components attached directly and securely to said stringer components.

4. A modular wheelchair ramp structure including at least two stringer components disposed in parallel relation to one another and as described in claim 2 above, wherein said at least two stringer components include a plurality of leg components having foot portions for placement directly to a ground surface and securely attached (in detachable fashion) to both of said exterior parallel channels thereof simultaneously, wherein a ramp component is inserted between said stringer components within the confines of said first and second panels, wherein said ramp component is disposed at a suitable angle from a highest level to the level of said ground surface such that said at least two stringer components are disposed at substantially the same angle as said ramp component, wherein said leg components are substantially perpendicular to said ground surface, and wherein said structure remains dimensionally stable without any need for any other support than said leg components attached directly and securely to said stringer components.

5. The ramp structure of claim 2 further including a plurality of such stringer components contacted and attached in linear fashion on either side of said ramp component, and further alternatively including weight-bearing metal strand structures inserted within at least one exterior channels of adjacent linearly aligned stringer components and secured in position such that said strand withstands weight pressures of both adjacent stringer components simultaneously.

6. The ramp structure of claim 5 wherein at least two parallel aligned strands of such a type are present.

7. The ramp structure of claim 3 further including a plurality of such stringer components contacted and attached in linear fashion on either side of said ramp component, and further alternatively including weight-bearing metal strand structures inserted within at least one exterior channels of adjacent linearly aligned stringer components and secured in position such that said strand withstands weight pressures of both adjacent stringer components simultaneously.

8. The ramp structure of claim 7 wherein at least two parallel aligned strands of such a type are present.

9. The ramp structure of claim 3 wherein said leg components are U-shaped and include at least one opening within the middle portion thereof for the introduction and attachment of connectors into said exterior channels of said stringer components.

10. The ramp structure of claim 4 wherein said leg components are U-shaped and include at least one opening within the middle portion thereof for the introduction and attachment of connectors into said exterior channels of said stringer components.

11. The ramp structure of claim 9 wherein said structure further includes the presence of handrails to said exterior channels of said stringer components.

12. The ramp structure of claim 10 wherein said structure further includes the presence of handrails to said exterior channels of said stringer components.

13. The ramp structure of claim 3 wherein said ramp component is made from metal, wooden, or both types of materials.

14. The ramp structure of claim 4 wherein said ramp component is made from metal, wooden, or both types of materials.

15. A method of erecting a wheelchair ramp comprising the steps of:

a) providing at least two stringer structures as in claim 1;

b) providing at least one ramp component;

c) contacting said ramp component to said string structures wherein said stringer structures are parallel to one another and said ramp is placed on bottom panels of both of said stringer structures;

d) providing at least two leg components, wherein said leg components include at least one opening for the introduction of connectors therethrough;

e) connecting said leg components to said stringer structures through the utilization of said connectors through said at least one leg opening and within both exterior channels of said stringer structure.

16. A method of erecting a wheelchair ramp comprising the steps of:

a) providing at least two stringer structures as in claim 2;

b) providing at least one ramp component;

c) contacting said ramp component to said string structures wherein said stringer structures are parallel to one another and said ramp is placed on bottom panels of both of said stringer structures;

d) providing at least two leg components, wherein said leg components include at least one opening for the introduction of connectors therethrough;

e) connecting said leg components to said stringer structures through the utilization of said connectors inserted through said at least one leg opening and within both exterior channels of said stringer structure and tightening said connectors.

17. The method of claim 15 further including step e) connecting at least one handrail having at least two separate openings for connector insertions and at least two base components for attachment to said stringer structure, wherein such openings are present within each of said base components in vertical alignment thereof, said connection being achieved through the utilization of connectors inserted through said openings are introducing extended ends thereof in said exterior channels of said stringer structure and tightening said connectors; wherein said handrails are placed at locations along said stringer structures that are different from the connection locations of said legs.

18. The method of claim 16 further including step e) connecting at least one handrail having at least two separate openings for connector insertions and at least two base components for attachment to said stringer structure, wherein such openings are present within each of said base components in vertical alignment thereof, said connection being achieved through the utilization of connectors inserted through said openings are introducing extended ends thereof in said exterior channels of said stringer structure and tightening said connectors; wherein said handrails are placed at locations along said stringer structures that are different from the connection locations of said legs.

* * * * *